US005290118A

United States Patent [19]

Ozeki

[11] Patent Number: 5,290,118

[45] Date of Patent: Mar. 1, 1994

[54] FILING DEVICE FOR STORING RECORDING DISCS

[75] Inventor: Jiro Ozeki, Tokyo, Japan

[73] Assignee: Slidex Corporation, Tokyo, Japan

[21] Appl. No.: 826,313

[22] Filed: Jan. 23, 1992

[30] Foreign Application Priority Data

Jan. 30, 1991 [JP] Japan ..... 10236

[51] Int. Cl.[5] ..... B42D 13/00; B42F 5/04

[52] U.S. Cl. ..... 402/79; 251/31; 251/38; 402/80 P; 402/80 R

[58] Field of Search ..... 281/15.1, 29, 31, 38; 402/79, 80 R, 80 P

[56] References Cited

U.S. PATENT DOCUMENTS

| | | | |
|---|---|---|---|
| 4,516,871 | 5/1985 | Leitman | 402/79 |
| 4,588,321 | 5/1986 | Egly | 281/31 X |
| 4,793,477 | 12/1988 | Manning et al. | 281/31 X |
| 4,850,731 | 7/1989 | Youngs | 402/79 |
| 4,852,740 | 8/1989 | Sellar et al. | 402/79 X |
| 4,965,948 | 10/1990 | Ruebens | 402/79 X |

*Primary Examiner*—Paul A. Bell

*Attorney, Agent, or Firm*—Michael O. Warnecke; Richard A. Speer

[57] ABSTRACT

A recording disc filing device for storing optical recording discs such as compact discs. The filing device includes a recording disc filing sheet having a plurality of recording disc storing sections for receiving recording discs, respectively. The recording disc storing sections are arranged in a predetermined pattern. The filing device further includes a leaflet filing sheet having leaflet storing sections for receiving leaflets carrying information on recorded contents in the recording discs stored in the recording disc storing sections. The leaflet storing sections correspond in number to the recording disc storing sections. The recording disc filing sheet and the leaflet filing sheet are arranged so that the leaflet storing sections in the leaflet filing sheet are located at positions corresponding to the recording disc storing sections in the recording disc filing sheet. The leaflet filing sheet is connected along one edge portion with the recording disc filing sheet so that the leaflet filing sheet can be laid over the recording disc filing sheet in a manner that the leaflet filing sheet can be turned over to expose the recording disc filing sheet.

7 Claims, 5 Drawing Sheets

FILING DEVICE FOR STORING RECORDING DISCS

BACKGROUND OF THE INVENTION

1. Field of the Invention

The present invention relates to a filing device. More particularly, the present invention pertains to a filing device for storing recording discs such as compact discs.

2. Description of the Prior Art

A recording disc of an optical recording type such as a compact disc has a very high recording density as compared with conventional recording discs so that the optical recording disc has a lot of contents recorded therein. In this type of recording disc, it is almost impossible to identify on the disc all of the contents recorded therein. It is therefore an usual practice that a leaflet is provided to give the user of the disc with information on the contents and the order of the recorded contents. The leaflet is stored in a case which is made of a hard plastic material for storing the optical recording disc. The storing case is then kept in storing box or a storing shelf.

In the manner of storing such optical recording discs as described above, inconveniencies have been experienced in that it has bee very difficult to identify the recorded contents in the condition where the disc is stored in the box or in the shelf. Speaking more specifically, when the recording discs are in the storing box or in the storing shelf, the only parts which the users can see are the edge portions of the disc storing cases which can have designations of only the titles of the recording discs. Thus, the users cannot get information on the details of the recorded contents unless they take out the discs from the storing box or shelf as the case may be.

SUMMARY OF THE INVENTION

It is therefore an object of the present invention to solve the aforementioned problems of the conventional recording disc storing system.

A specific object of the present invention is to provide a filing device for recording discs in which the information on the recorded contents can readily be obtained.

According to the present invention, the above and other objects can be accomplished by a filing device for recording discs including a recording disc filing sheet having a plurality of storing sections provided therein in parallel with each other and a leaflet filing sheet having a plurality of storing sections for storing leaflets carrying information on recorded contents in the recording discs stored in the storing sections in the recording disc filing sheet.

According to one aspect of the present invention, the leaflet filing sheet is provided with the storing sections which are corresponding in number with the storing sections in the recording disc filing sheet. The storing sections in the leaflet filing sheet are arranged in a way that corresponds to the way in which the storing sections in the recording disc filing sheet are arranged. The recording disc filing sheet and the leaflet filing sheet are arranged to be placed each other so that the storing sections in the recording disc filing sheet correspond in positions with the storing sections in the leaflet filing sheet, respectively, and bound so that the filings sheets can be turned over. It is preferred that the filing sheets are bound so that they can be taken out and inserted as desired.

According to another aspect of the present invention, the leaflet filing sheet is combined with the recording disc filing sheet in a manner that the sheets can be turned over separately. For the purpose, the leaflet filing sheet is connected along one edge portion with the recording filing sheet by means of a hinge structure. The leaflet filing sheet may be composed of a plurality of sheet sections each having one or more of the leaflet storing sections so that the leaflet storing sections in the sheet sections constituting the leaflet filing sheet correspond in number to the storing sections in the recording filing sheet.

According to a further aspect of the present invention, the recording disc filing sheet has a plurality of disc storing sections which are arranged in rows and columns. The leaflet storing sheet includes a plurality of leaflet storing sections which are arranged in a row in a number corresponding to the number of the recording disc storing sections in each row of the recording disc filing sheet. A suitable number of leaflet filing sheets are then arranged with respect to the recording disc filing sheet so that the row of the leaflet storing sections in each of the leaflet filing sheets corresponds to each row of the recording disc storing sections in the recording filing sheet. The leaflet filing sheets are connected with the recording disc filing sheet in a manner that the leaflet filing sheets can be turned over with respect to the recording disc filing sheet.

According to the present invention, the leaflet storing sections in the leaflet filing sheets can be located at positions corresponding to the respective ones of the disc storing sections in the recording disc filing sheets. The leaflet filing sheets are connected or bound with respect to the recording disc filing sheets so that the former can be turned over with respect to the latter. The user of the filing device stores recording discs in the disc storing sections in the recording disc filing sheets and the leaflets of the recording discs in the corresponding ones of the leaflet storing sections. It is possible to readily obtain information on the contents of the recording discs by turning over the leaflet filing sheet so that the leaflets in the leaflet storing sections can be visually observed.

The invention will further be described with reference to preferred embodiments which are shown in the accompanying drawings.

DESCRIPTION OF THE PREFERRED EMBODIMENT

Figure 1:
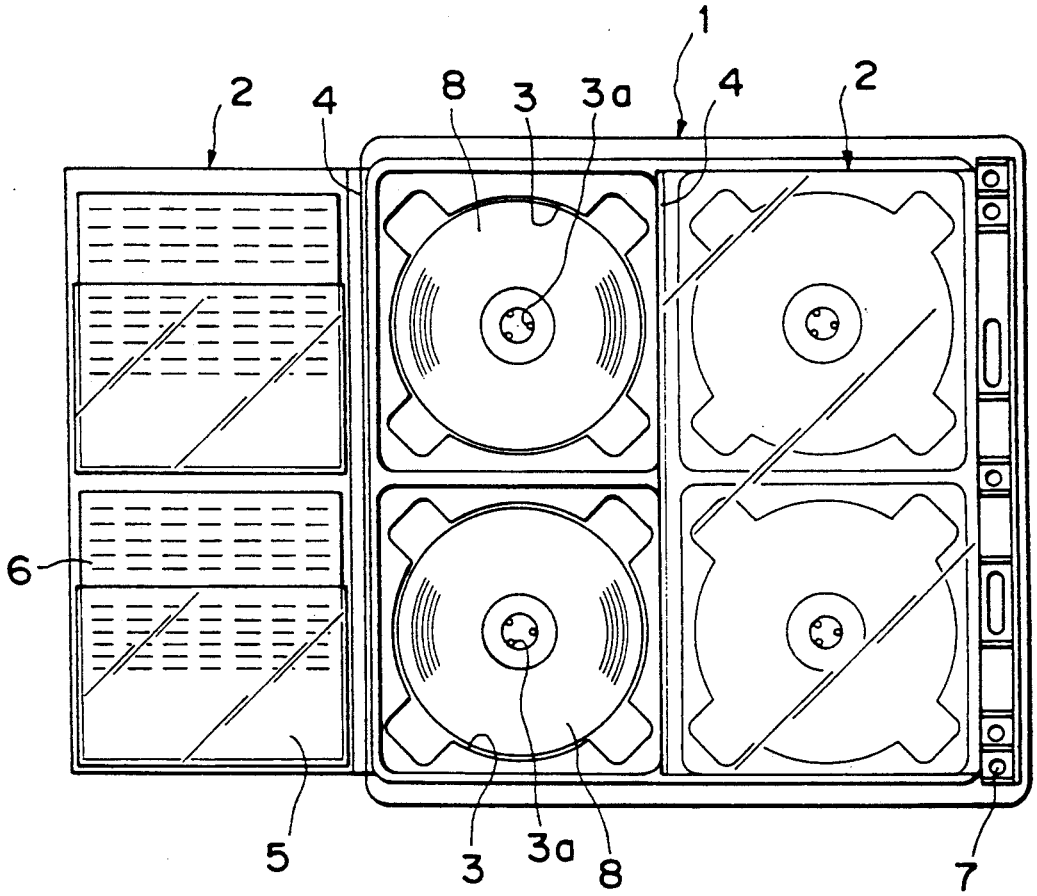
FIG. 1 is a plan view of a filing device in accordance with one embodiment of the present invention.
Figure 2:
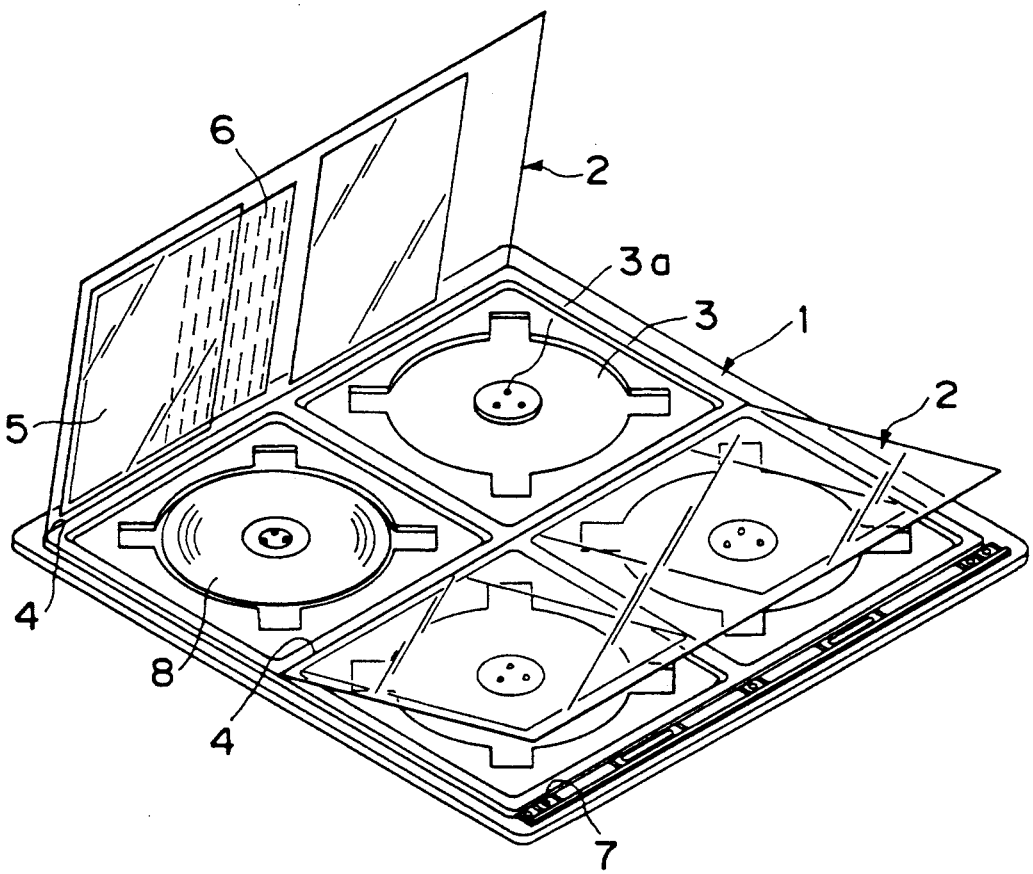
FIG. 2 is a perspective view of the filing device shown in FIG. 1.

Referring to the drawings, particularly to FIGS. 1 and 2, there is shown a filing device including a recording disc filing sheet 1 which is made of a transparent plastic material. The filing sheet 1 is formed with four circularly recessed portions or recording disc storing sections 3 which are arranged in row and column directions. More specifically, two storing sections 3 are arranged in a row direction and two in a column direction. In each of the storing sections 3, there is formed a projection 3*a* at the center of the circle of the recess for engagement with a central aperture formed in the recording disc.

The filing device further includes leaflet filing sheets 2 each of which is also made of a transparent plastic material and of a planar or flat configuration. Each of the leaflet filing sheets 2 is of a rectangular shape which can cover the portion of the recording disc filing sheet 1 having two storing sections 3 which are arranged in the row direction. One such leaflet filing sheet 2 is provided s that it covers the recording disc storing sections 3 in each row. One of the leaflet filing sheets 2 has a longitudinal edge portion laid along a longitudinal edge portion of the recoding disc filing sheet 1 and connected thereto by means of a hinge 4. The other leaflet filing sheet 2 has a longitudinal edge portion which is laid along a longitudinal line of the recording disc filing sheet 1 between the two rows of the recording disc storing sections 3 and connected to the recording disc filing sheet 1 by means of a hinge 4.

Each of the leaflet filing sheets 2 has leaflet storing sections 5 which are in the form of pockets and located at positions corresponding to the storing sections 3 in each row of the recording disc filing sheet 1. The leaflet storing sections 5 are adapted for inserting leaflets 6 which bear information on the contents of recording discs stored in the storing sections 3 corresponding in position to the leaflet storing sections 5. It will be understood that the recording disc filing sheet 1 has an edge portion which is free from the hinges 4 for connecting the leaflet filing sheets 2 to the recording disc filing sheet 1. Along this free edge portion; the recording disc filing sheet 1 is formed with a series of binding apertures 7 which are used to bind the filing sheet 1 in a file.

In use, optical recording discs 8 are stored in respective ones of the disc storing sections 3 in the recording disc filing sheet 1 as shown. Leaflets 6 corresponding to the recording discs 8 stored in the respective storing sections 3 in the filing sheet 1 are inserted into corresponding ones of the leaflet storing sections 5 in the leaflet filing sheet 2. The recording disc filing sheet 1 with the leaflet filing sheets 2 may then be bound in a file. Conveniently, the leaflets 6 may be inserted into the pockets or storing sections 5 so that their faces carrying the titles of the contents in the recording discs 8 are faced outside. Then, it will be possible to have a view to the titles without turning over the leaflet filing sheets 2. When the user finds a desired title, he may turn over the leaflet filing sheet 2 to read details of the leaflet 6 so that he can get more detailed information on the contents in the recording disc 8.

Figure 3:
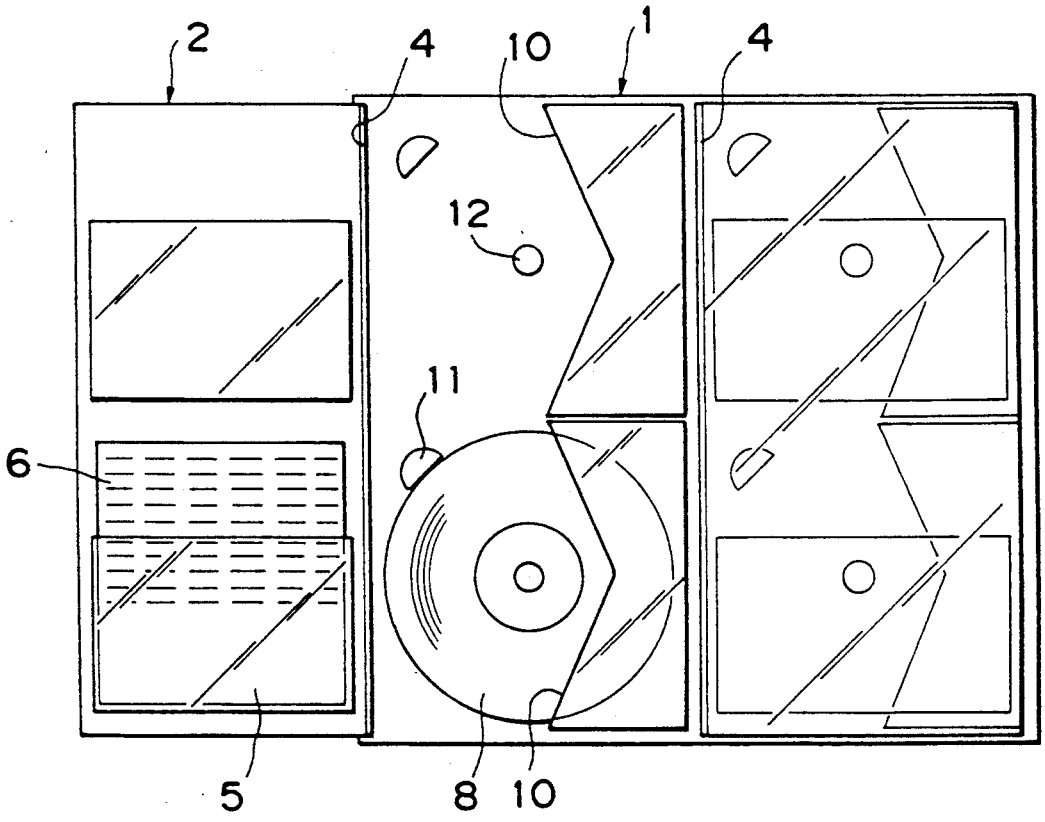
FIG. 3 is a plan view of the filing device in accordance with another embodiment of the present invention.

Referring now to FIG. 3 which shows another embodiment of the present invention, the structure shown therein is substantially the same as that of the previously described embodiment so that corresponding parts are designated by the same reference numerals and detailed description will be omitted. In this particular embodiment, each of the recording disc storing sections 3 in the filing sheet 1 is formed with a pocket 10 for inserting a recording disc 8. The pocket 10 is of a size which is enough to receive approximately ⅓ of the disc 8. There is further provided in each of the storing sections 3 a projection 11 which is adapted to be engaged with a free edge portion of the recording disc 8. At the center of the recording disc storing section 3, there is further formed a projection 12 which is adapted to be engaged with the central aperture of the recording disc 8.

In the embodiments described, one of the leaflet filing sheets 2 is connected along one edge portion with the recording disc filing sheet 1 at one longitudinal edge portion of the filing sheet 1. The other leaflet filing sheet 2 is connected along its longitudinal edge portion with the recording disc filing sheet 1 at the longitudinal line between the rows of the disc storing sections 3. It should be understood that the second one of the leaflet filing sheets 2 may be connected to the recording disc filing sheet 1 along the other longitudinal edge portion of the filing sheet 1.

Figure 4:
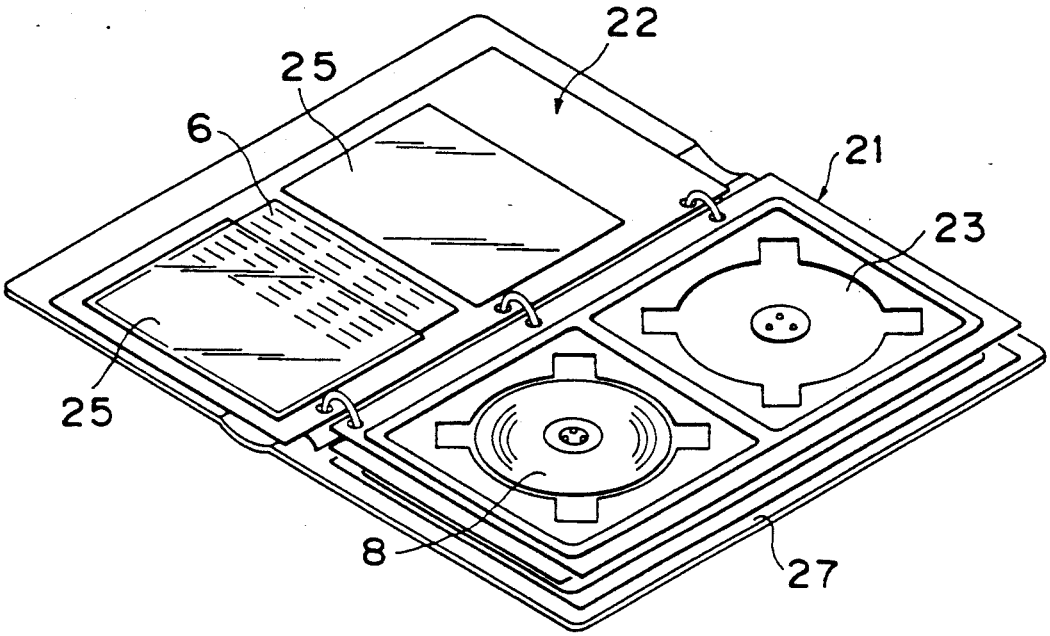
FIG. 4 is a perspective view of the filing device in accordance with a further embodiment of the present invention.
Figure 5:
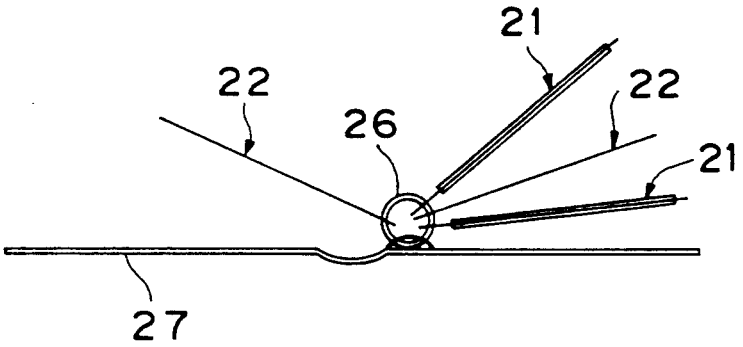
FIG. 5 is an end view of the filing device shown in FIG. 4.

Referring to FIGS. 4 and 5, there is shown a further embodiment of the present invention. This embodiment includes a recording disc filing sheet 21 which is made separate from a leaflet filing sheet 22. A plurality of such recording disc filing sheets 21 are removably bound in a file binder 26 having cover sheets 27 together with a corresponding number of leaflet filing sheets 22. The recording disc filing sheets 21 and the leaflet filing sheets 22 are alternately placed and bound in the file binder 26. In this embodiment, the recording disc filing sheet 21 is formed with two disc storing sections 23 for receiving recording discs 8. The leaflet filing sheet 22 is formed with leaflet storing sections or pockets 25 at positions corresponding to the disc storing sections 23 in the filing sheet 21.

Figure 6:
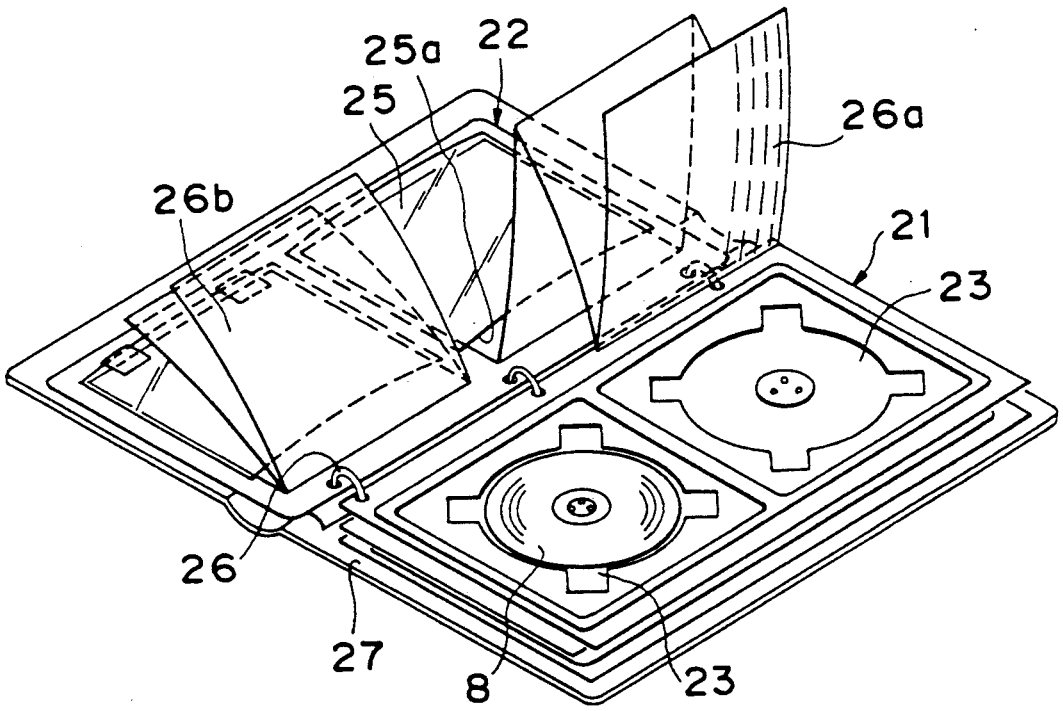
FIG. 6 is a perspective view of the filing device in accordance with a further embodiment of the present invention.

FIG. 6 shows a further embodiment of the present invention. In this embodiment, the leaflet storing sections 25 have openings 25*a* which are directed sidewardly. The configuration of the leaflet storing section 25 in this embodiment is suitable for receiving a leaflet 26*a* or 26*b* which is folded or bound as shown. The leaflet 26*a* may be inserted only at the cover portion into the storing section 25 and the remaining portions may be kept outside the storing section 25.

The invention has thus been shown and described with reference to specific embodiments, however, it should be noted that the invention is in no way limited to the details of the illustrated structures but changes and modifications may be made without departing from the scope of the appended claims.

I claim:

1. A recording disc filing device which comprises:

at least one recording disc filing sheet having a plurality of circularly recessed portions each defining a recording disc storing section for engagingly receiving recording discs, respectively, said recording disc storing sections being arranged in at least one row;

said sheet further including a projection at the center of each of the said circularly recessed portions for engagement with a central aperture formed in said recording discs for securing said recording discs within said recording disc storage sections;

at least one leaflet filing sheet of a substantially planar configuration made of a transparent material and having leaflet storing sections for receiving leaflets carrying information on recorded contents in the recording discs stored in said recording disc storing sections, said leaflet storing sections being corresponding in number and arranged to correspond to the arrangement of said recording disc storing sections;

said recording disc filing sheet and said leaflet filing sheet being laid over said recording disc filing sheet so that said leaflet storing sections in said leaflet filing sheet are located at positions corresponding to said recording disc storing sections in said recording disc filing sheet, said leaflet filing sheet associated with said recording disc filing sheet so that said leaflet filing sheet can be turned over to expose said recording disc filing sheet.

2. A recording disc filing device in accordance with claim 1 which includes a plurality of said leaflet filing sheets, each of said leaflet filing sheets having said leaflet storing sections corresponding in number to a part of said plurality of recording disc storing sections in said recording disc filing sheet, total number of said leaflet storing sections in said plurality of leaflet filing sheets being equal to the number of said recording disc storing sections in said recording disc filing sheet, each of said leaflet filing sheets being associated with said recording disc filing sheet so that it can be laid over the recording disc filing sheet.

3. A recording disc filing device comprising:

at least one recording disc filing sheet having a plurality of circularly recessed portions each defining a recording disc storing section for securely storing recording discs, said recording disc storing sections being arranged in a plurality of rows, each row containing a plurality of said recording disc storing sections;

a plurality of leaflet filing sheets of a substantially planar configuration made of a transparent material and corresponding in number to said rows of recording disc storing sections in said recording disc filing sheet, each of said leaflet filing sheets having a plurality of leaflet storing sections corresponding in number to the recording disc storing sections arranged in one row in said recording disc filing sheet, said leaflet storing section being adapted for receiving leaflets carrying information on recorded contents in said recording discs stored in said recording disc storing sections in said recording disc filing sheet;

said leaflet filing sheets being arranged so that they correspond to respective ones of said rows of said recording disc storing sections in said recording disc filing sheet in a manner that said leaflet filing sheets can be laid over said recording disc filing sheet to cover the respective ones of rows of said recording disc storing sections in said recording disc filing sheet, said leaflet filing sheet being able to be turned over to expose said recording disc filing sheet.

4. A recording disc filing device in accordance with claim 3, wherein said recording disc storing sections being arranged in two rows, said leaflet filing sheets being connected along edge portions with said recording disc filing sheet through hinge means.

5. A recording disc filing device in accordance with claim 4, wherein one of said leaflet filing sheets is connected with said recording disc filing sheet along one longitudinal edge portion of said recording disc filing sheet, the other of said leaflet filing sheet being connected with said recording disc filing sheet along a longitudinal line between said rows of said recording disc storing sections.

6. A recording disc filing device comprising:

at least one recording disc filing sheet having a plurality of circularly recessed portions each defining a recording disc storing section for engagingly receiving recording discs, respectively, said recording disc storage sections being arranged in at least one row;

said circularly recessed portions further each including a projection at the center thereof for engagement with a central aperture formed in said recording discs for securing said recording discs within said recording disc storage sections;

at least one leaflet filing sheet of a substantially planar configuration made of a transparent material and having leaflet storing sections for receiving leaflets carrying information on recorded contents in the recording discs stored in said recording disc storing sections, said leaflet storing sections being corresponding in number and arranged to correspond to the arrangement of said recording disc storing sections;

said recording disc filing sheet and said leaflet filing sheet being arranged so that said leaflet storing sections in said leaflet filing sheet are located at positions corresponding to said recording disc storing sections in said recording disc filing sheet so that said leaflet filing sheet being connected along one edge portion with said recording disc filing sheet so that said leaflet filing sheet can be laid over said recording disc filing sheet in a manner that the leaflet filing sheet can be turned over to expose said recording disc filing sheet.

7. A combination of at least one recording disc filing sheet and at least one leaflet filing sheet;

said recording disc filing sheet having a plurality of circularly recessed portions each defining a recording disc storing section for engagingly receiving recording discs, said recording disc storing sections being arranged in a pattern;

said circularly recessed portions further each including a projection at the center thereof for engagement with a central aperture formed in said recording discs for securing said recording discs within said recording disc storage sections;

said leaflet filing sheet of a substantially planar configuration made of a transparent material having a plurality of leaflet storing sections for receiving leaflets carrying information on recorded contents in said recording discs stored in said recording disc storing sections in said recording disc filing sheet, said plurality of leaflet storing sections being arranged in a pattern corresponding to said pattern in which said recording disc storing sections are arranged.

* * * * *